US008320603B2

(12) United States Patent
Bass

(10) Patent No.: US 8,320,603 B2
(45) Date of Patent: Nov. 27, 2012

(54) EARPHONE EAR LOOP

(76) Inventor: Robert Bass, Jacksonville Beach, FL (US)

( * ) Notice: Subject to any disclaimer, the term of this patent is extended or adjusted under 35 U.S.C. 154(b) by 224 days.

(21) Appl. No.: 12/590,775

(22) Filed: Nov. 13, 2009

(65) Prior Publication Data

US 2010/0124349 A1 May 20, 2010

Related U.S. Application Data

(60) Provisional application No. 61/199,447, filed on Nov. 17, 2008.

(51) Int. Cl.
*H04R 25/00* (2006.01)

(52) U.S. Cl. ..... 381/381; 381/330

(58) Field of Classification Search ..... 381/330, 381/374, 378, 381, 385
See application file for complete search history.

(56) References Cited

U.S. PATENT DOCUMENTS

| | | | | |
|---|---|---|---|---|
| 1,587,643 | A | 6/1926 | Harman | |
| 2,474,135 | A | 6/1949 | White | |
| 3,851,123 | A | 11/1974 | Lipinski et al. | |
| 5,412,736 | A | 5/1995 | Keliiliki | |
| 5,625,171 | A | 4/1997 | Marshall | |
| D471,537 | S | 3/2003 | Ham | |
| 6,771,790 | B2 | 8/2004 | Liu | |
| 7,050,598 | B1 | 5/2006 | Ham | |
| 2007/0263896 | A1 | 11/2007 | Chen | |
| 2008/0247590 | A1* | 10/2008 | Sun | 381/381 |
| 2008/0310666 | A1* | 12/2008 | Wengreen | 381/381 |
| 2011/0164778 | A1* | 7/2011 | Wengreen | 381/381 |
| 2011/0170731 | A1* | 7/2011 | Beckhart | 381/381 |

* cited by examiner

*Primary Examiner* — Fan Tsang
*Assistant Examiner* — Phylesha Dabney
(74) *Attorney, Agent, or Firm* — Thomas C. Saitta

(57) ABSTRACT

An ear loop, and an assembly of an ear loop and ear bud, wherein the ear loop retains the shaft of the ear bud such that the position and angle of the ear bud relative to the ear loop can be adjusted axially and rotationally.

10 Claims, 4 Drawing Sheets

EARPHONE EAR LOOP

This application claims the benefit of U.S. Provisional Patent Application Ser. No. 61/199,447, filed Nov. 17, 2008, the disclosure of which is incorporated herein by reference.

BACKGROUND OF THE INVENTION

This invention relates generally to the field of earphones, and more particularly to earphones comprising an ear loop to retain the earphone in place, and even more particularly to earphone assemblies comprising the combination of an ear bud and an ear loop.

Headsets and earphones for transmitting audio directly into a listener's ears while minimizing escape of the audio into the environment are well known for use with communication equipment and music systems. One type utilizes a curved resilient headband that extends between two sets of earphones, the headband extending across the top of the user's head. The earphones in these systems usually comprise padded cup members that are generally circular or oval and press against the user's ears, the small speakers being located within the concave portion of the cup members. Another type of earphone system comprises a pair of earplugs that are inserted into the ear canals, the earplugs having an extended tubular member that abuts the walls of the ear canal such that the earplugs are held in place by slight compressive forces.

A more modern variation of the earplug system utilizes a pair of ear buds, where each ear bud comprises a disk-shaped speaker housing joined generally perpendicularly to an elongated cylindrical shaft through which the speaker wire is passed. The speaker housing is sized such that it is too large to fit into the ear canal, and is instead retained in place adjacent the canal within the concha, anti-tragus and tragus of the ear due to the slight compressive forces imparted by these morphological features against the disk-shaped portion of the ear bud.

This ear bud design has several drawbacks. While generally comfortable in most circumstances, the ear buds will tend to locate in a single location relative to the ear based on the morphology of each individual, and there is no means for altering the position of the ear bud. This can lead to discomfort when the ear buds are worn for long periods of time. In addition, the position and direction of the small speakers cannot be adjusted, such that optimum sound quality may be unattainable, or such that the ear bugs cannot be adjusted to lessen or allow in more ambient noise (which may be desirable, for example, when jogging along roadways). Sometimes, the shape of the ear bud does not conform well to the shape of the user's ear, such that the ear buds either fall out easily or create discomfort by compressing parts of the ear. In particular, when performing strenuous or rapid jarring movements, such as when running, dancing, exercising, etc., the ear buds are often jarred free from the ear. Excessive perspiration increases the likelihood that the ear buds will slip out of the ear.

In an attempt to address these ear bud problems, it is known to provide ear loops for the ear buds, the ear loops each comprising a curved or hooked extension that is connected to the ear bud in a manner such that the loop portion extends above and behind the ear flap. Usually the ear loops are composed of a resilient but relatively rigid plastic such that the loop portion provides a compressive force against the back of the ear. While the use of ear loops helps to minimize slippage of the ear buds, known designs suffer because they do not address the adjustability issue.

Examples of prior art include U.S. Pat. No. 1,587,643 to Harman, U.S. Pat. No. 3,851,123 to Lipinski et al., U.S. Pat. No. 6,771,790 to Liu, U.S. Pat. No. 7,050,598 to Ham, and U.S. Patent Application Publication No. 2007/0263896. The Harman device shows an ear loop with an ear plug speaker, but the orientation of the ear plug speaker is not adjustable relative to the ear loop, since the ear plug shaft is polygonal in cross-section and longitudinally tapered, such that no rotation or axial repositioning can be accomplished.

It is an object of this invention to provide an ear loop, and a combination ear bud and ear loop assembly, such that the ear buds are secured within the ear and are not prone to falling out even during strenuous or jarring movement, and which further allows the location of the ear bud's disk-shaped speaker housing to be altered or adjusted in multiple directions to best fit the ear morphology of an individual user. It is a further object to provide such an ear loop or assembly whereby the ear loop connects to the ear bud in a manner such that the ear bud can be adjusted relative to the ear loop longitudinally in the direction of the ear bud shaft axis and rotationally about the ear bud shaft axis.

SUMMARY OF THE INVENTION

The invention is an ear loop for use with an ear bud, or the combination ear bud and ear loop assembly, wherein the ear bud comprises a generally disk-shaped speaker housing connected generally perpendicularly to an elongated, cylindrical ear bud shaft, the ear bud shaft defining an ear bud shaft axis, and wherein the ear loop comprises a hook portion configured to extend from the concha region of the ear, above and then behind the ear flap, the forward portion of the ear loop comprising means for retaining the ear bud shaft, the retaining means preferably comprising a clip having a pair of resilient curved arms that snuggly encircle the ear bud shaft. The ear bud shaft retaining means are structured such that the ear bud shaft and ear bud speaker housing can be moved relative to the ear loop in both axial directions, and further such that the ear bud shaft and ear bud speaker housing can be rotated about the ear bud shaft axis.

With this structure, when the ear loop is positioned on the user's ear, the location and angle of the ear bud speaker housing can be adjusted to a plurality of preferred retentions positions that are most comfortable for the user and which allow or exclude ambient noise.

DETAILED DESCRIPTION OF THE INVENTION

Figure 1:
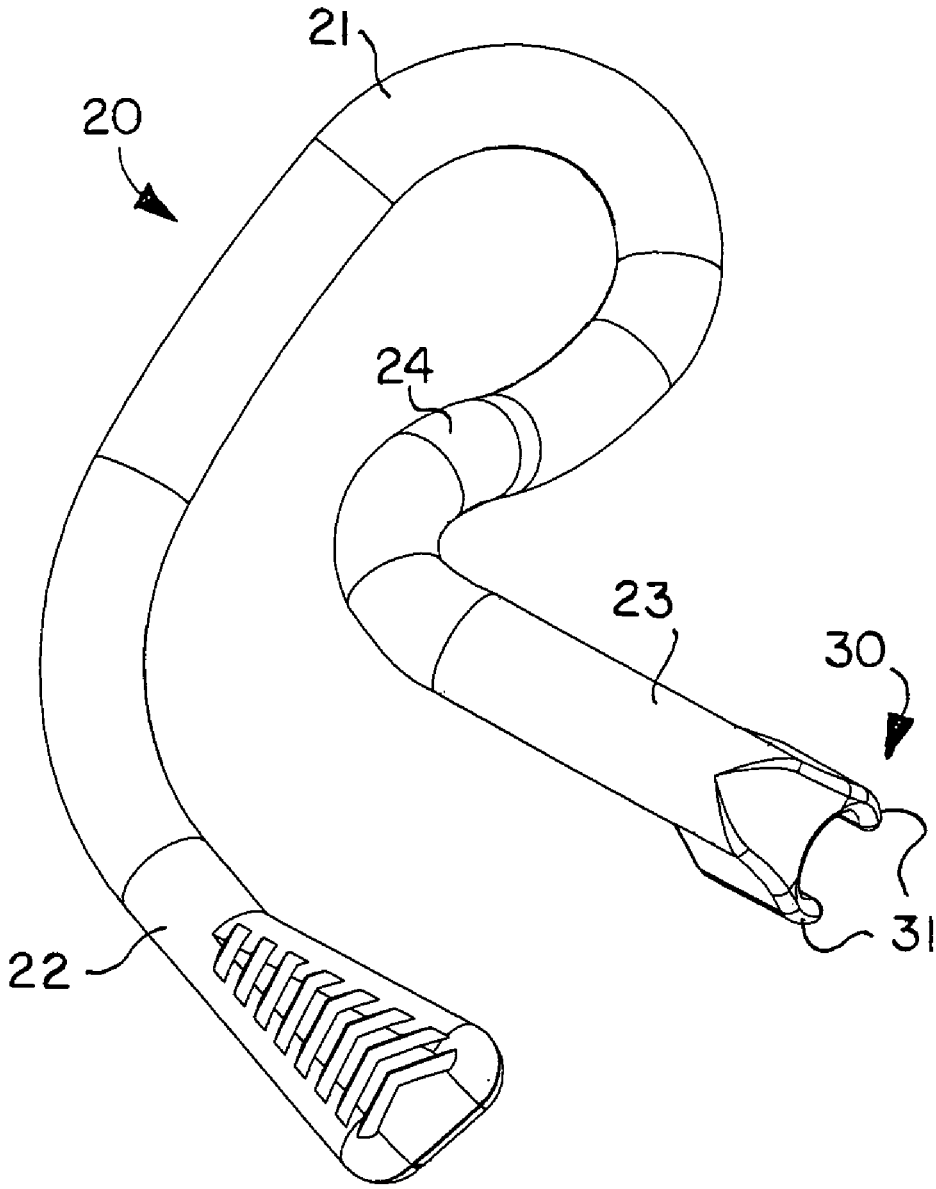
FIG. 1 is a perspective view of a right side ear loop.
Figure 2:
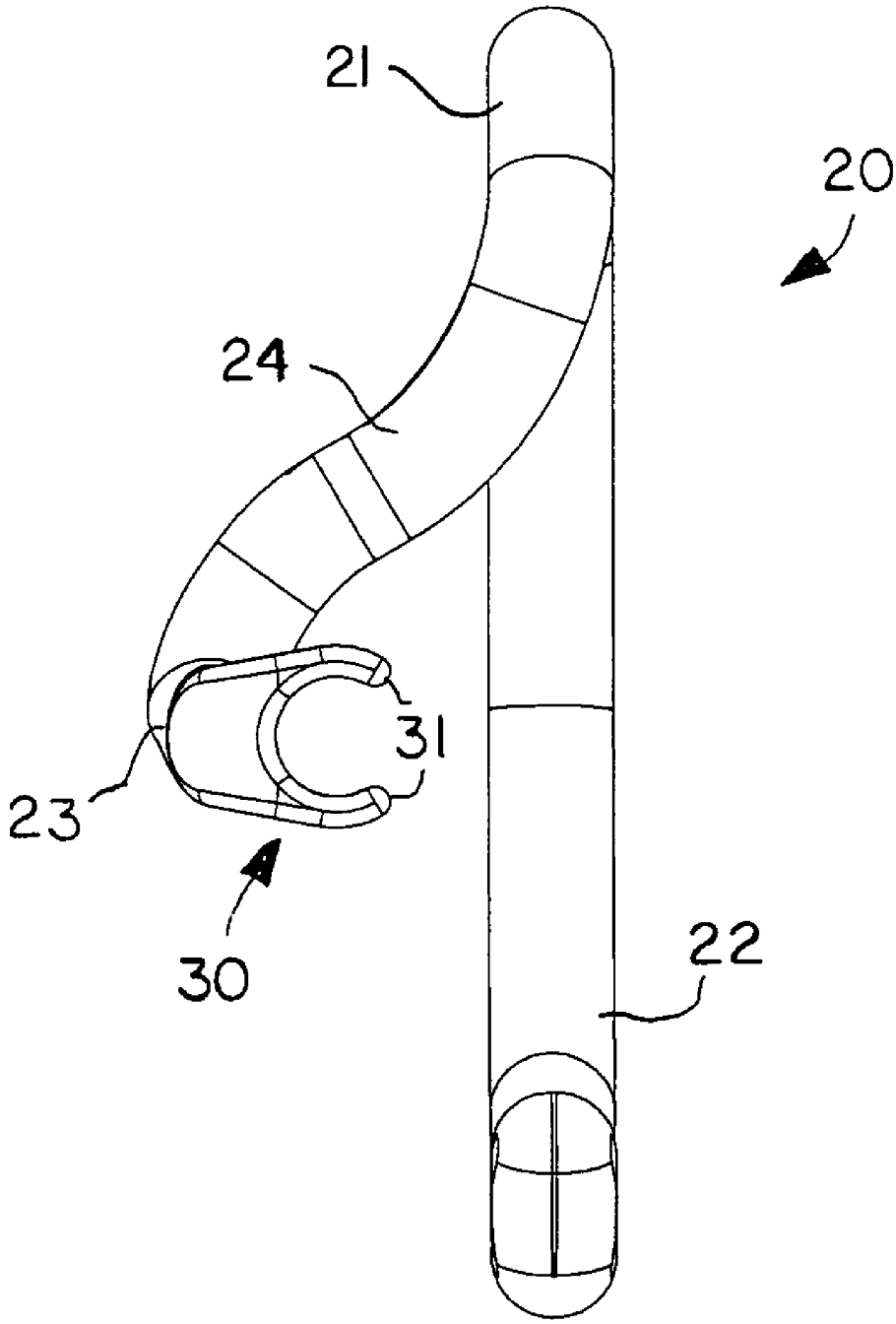
FIG. 2 is a front view of a right side ear loop.
Figure 3:
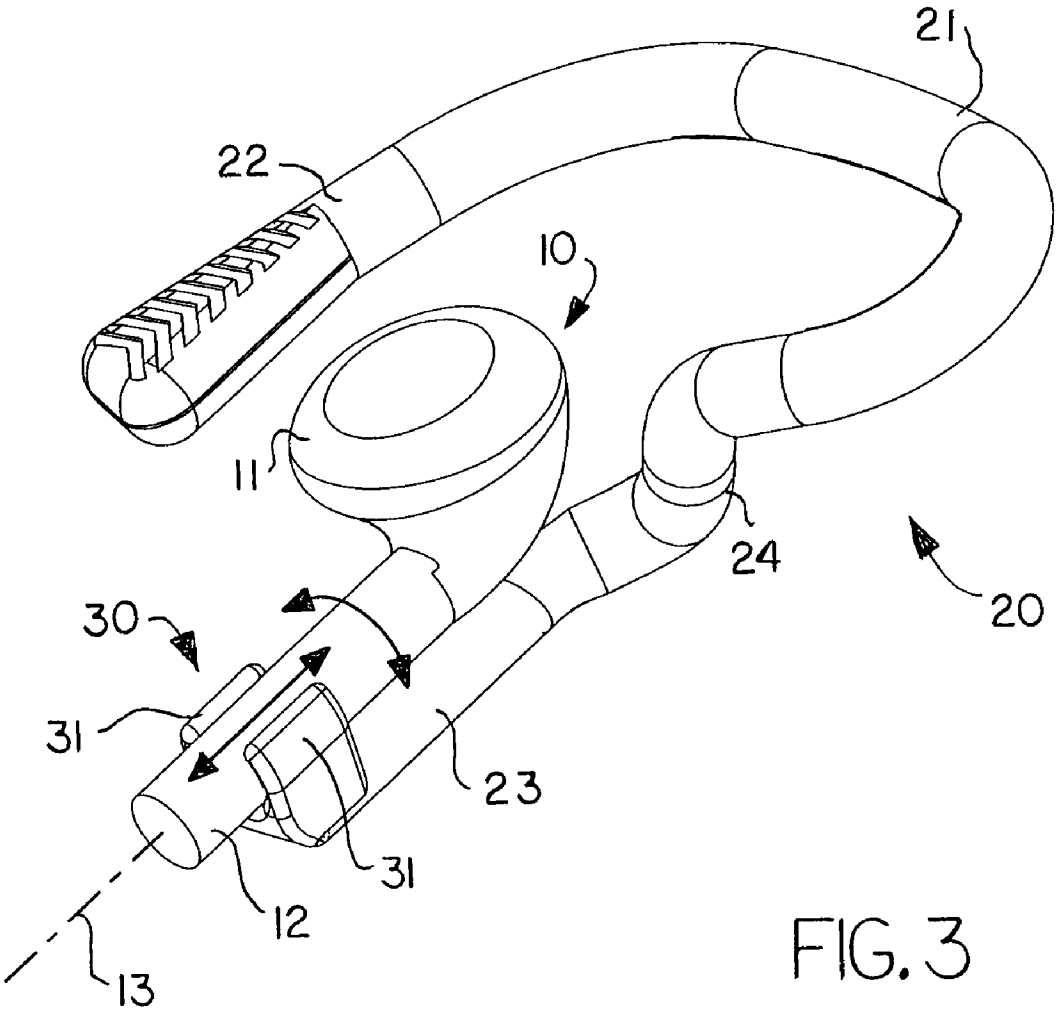
FIG. 3 is a perspective view of a left side ear loop and ear bud in combination.
Figure 4:
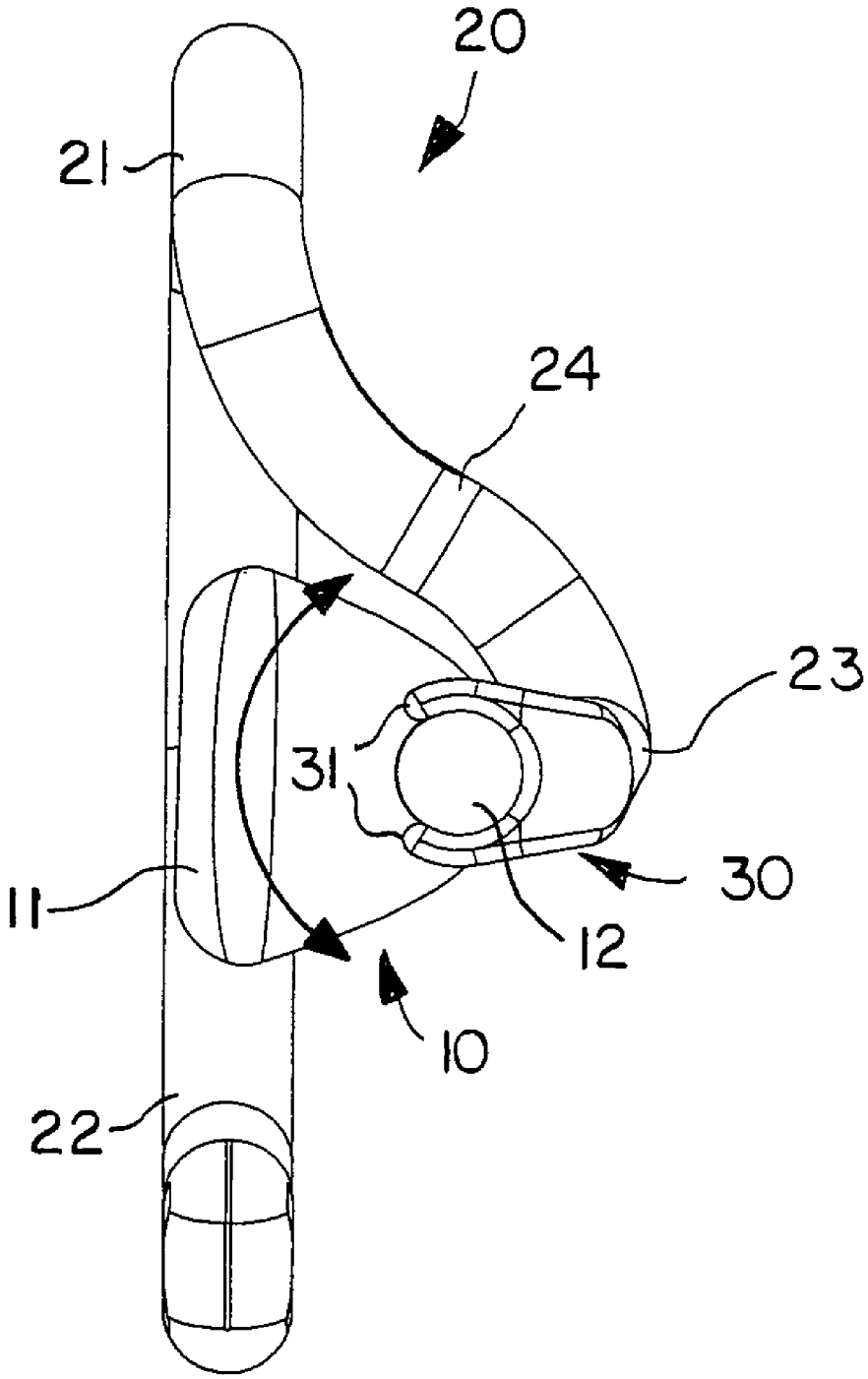
FIG. 4 is a front view of a left side ear loop and ear bud in combination.

With reference to the drawings, the invention will now be described in detail with regard for the best mode and the preferred embodiment. In general, the invention comprises an ear loop adapted for use with an ear bud, or the combination of the ear loop and ear bud into an assembly. As used herein, references to a front or forward direction shall be taken to be the direction toward the front of the head when the ear loops are being worn, with references to a rear or back direction being the opposite. References to an inward or inner direction shall be taken to be the direction toward the head when the ear loops are being worn, with references to an outward or external direction being the opposite. For a pair of ear loops there will be a right-side version and a left-side version to accommodate the right and left ear configurations, the right-side version and left-side versions being mirror images of each other.

An ear bud 10 comprises a generally disk-shaped speaker housing 11 that retains the earphone speaker. The speaker housing 11 is sometimes provided with a foam or cloth cover. The speaker housing 11 is connected to a short, elongated ear bud shaft 12, the shaft 12 being cylindrical and defining an ear bud axis 13. The speaker housing 11 is connected generally perpendicularly to the shaft 12. Communication wiring (not shown) runs from the speaker (not shown) inside the speaker housing 11 and out of the free end of the ear bud shaft 12 for connection to an audio device. The diameter of the ear bud speaker housing 11 is sized such that the speaker housing 11 is too large to pass into the ear canal. Ear buds 10 as described are well known in the art.

The ear loop 20 is structured and designed so as to retain the ear bud 10 in place on the ear adjacent the ear canal opening. The ear loop 20 comprises a hook portion 21 that mounts onto the ear, a rear segment 22 that rests behind the ear flap adjacent the head, and a forward segment 23 that is joined to, transitions into or comprises a retainer means 30 for retaining the ear bud shaft 12 in a plurality of fixed positions and orientations relative to the ear loop 20 in a manner that allows axial and rotational movement of the ear bud shaft 12 relative to the ear loop 20. The forward segment 23 is joined to the hook portion 21 by a curved transition segment 24. The hook portion 21 and rear segment 22 preferably occupy a single plane, while the transition segment 24 extends outwardly from that plane such that the forward segment 23 is positioned in a parallel plane a short distance out from the plane containing the hook portion 21 and rear segment 22. The ear loop 20 is preferably composed of a slightly resilient or flexible, yet relatively rigid, plastic, such that the rear segment 22 can be biased against the rear of the ear to more securely retain the device in place.

The forward segment 23 of the ear loop 20 is preferably generally linear. The ear bud shaft retaining means 30 is adapted to receive and retain the ear bud shaft 12 in a snug manner utilizing compressive forces or a friction fit, whereby the ear bud shaft 12 is securely retained in a fixed position relative to the ear loop 20, but which position can be altered and adjusted by the user by applying sufficient force to overcome the fixation forces. In the embodiment as shown, the retaining means 30 comprises a pair of curved, resilient arm members 31 sized and shaped such that the arm members 31 can be slid onto or snapped onto ear bud shaft 12, the configuration and spacing of the arm members 31 being such that the cylindrical outer surface of the ear bud shaft 12 is securely retained—the outer diameter of the ear bud shaft 12 being slightly greater than the inner diameter defined by the curved arm members 31, such that the arm members 31 are biased apart when the ear bud shaft 12 is inserted. The arm members 31 face inwardly such that the ear bud shaft 12 is positioned to the inside of the forward segment 23.

With this structure, the position and angle of the ear bud 10 relative to the ear loop 20 can be altered and adjusted in multiple directions. The ear bud 10 can be moved in either direction along the axis 13 of the ear bud shaft 12 so as to elongate or shorten the overall assembly. Furthermore, since the ear bud shaft 12 is cylindrical on its outer surface, the ear bud shaft 12 can be rotated about its axis 13 relative to the ear loop 20, which in turn alters the angle of the ear bud speaker housing 11 relative to the ear when worn. Thus, with the ear loop 20 connected to the ear bud 10 and the ear loop 20 mounted on the ear of the user, the user can adjust the ear bud 10 to the best position for sound and comfort in multiple directions, the ear loop 20 being capable of retaining the ear bud in a plurality of fixed or retained positions and orientations.

Preferably, the forward segment 23 of the ear loop 20 is joined to the hook portion 21 and rear segment 22 such that with the ear bud 10 properly retained on the ear, the axis 13 of the ear bud shaft 12 is generally parallel to the lower line of the jaw bone, as this makes it less likely that the ear bud shaft 12 will impinge on portions of the ear to cause discomfort.

It is contemplated that equivalents and substitutions for certain elements and structure described above may be obvious to one of ordinary skill in the art, and therefore the true scope and definition of the invention is to be as set forth in the following claims.

I claim:

1. An ear bud retaining ear loop, said ear loop comprising a hook portion, a rear segment joined to said hook portion, a forward segment joined to said hook portion by a curved non-planar transition segment, and retaining means for adjustably retaining an ear bud in a plurality of fixed positions and orientations relative to said ear loop in a manner that allows axial and rotational adjustment of the ear bud relative to said ear loop, said retaining means mounted on said forward segment;

said ear bud comprising a disk-shaped speaker housing and an elongated cylindrical shaft, said shaft defining an axis;

wherein said ear bud shaft angles downward from said ear bud speaker housing;

wherein with said ear loop in an unbiased and unflexed state, said hook portion and said rear segment lie in a first plane, said transition segment extends outwardly from said first plane, and said forward segment lies in a second plane that is not coplanar with but is parallel to said first plane.

2. The ear loop of claim 1, wherein said means for retaining an ear bud in a manner that allows axial and rotational movement of the ear bud relative to said ear loop comprises a pair of curved, resilient arm members.

3. An ear loop adapted to retain an ear bud;

said ear bud comprising a disk-shaped speaker housing and an elongated cylindrical shaft, said shaft defining an axis;

said ear loop in an unbiased and unflexed state comprising an upper hook portion, a lower rear segment joined to said hook portion, a forward segment joined to said hook portion by a curved non-planar transition segment, and retaining means for adjustably retaining said ear bud in a plurality of fixed positions and orientations relative to said ear loop in a manner that allows both axial and rotational movement of said ear bud shaft about said ear bud axis, said retaining means mounted on said forward segment;

wherein said ear bud shaft angles downward from said ear bud speaker housing;

wherein said forward segment is oriented relative to said rear segment such that with said ear bud retained by said retaining means, said ear bud axis extends forward and rearward.

4. The ear loop of claim 3, wherein said retainer means comprises a pair of curved, resilient arm members.

5. The ear loop of claim 4, wherein said arm members face inward.

6. The ear loop of claim 3, wherein said hook portion and said rear segment lie in a first plane, said transition segment extends outwardly from said first plane, and said forward segment lies in a second plane that is not coplanar with but is parallel to said first plane.

7. An ear loop adapted to retain and position an ear bud on an ear of a human head having a lower jawline;

said ear bud comprising a disk-shaped speaker housing and an elongated cylindrical shaft, said shaft defining an axis;

said ear loop in an unbiased and unflexed state comprising an upper hook portion, a lower rear segment joined to said hook portion, a forward segment joined to said hook portion by a curved non-planar transition segment, and retaining means for adjustably retaining said ear bud in a plurality of fixed positions and orientations relative to said ear loop in a manner that allows both axial and rotational movement of said ear bud shaft about said ear bud axis, said retaining means mounted on said forward segment;

wherein said ear bud shaft angles downward from said ear bud speaker housing;

wherein said forward segment is oriented relative to said rear segment such that with said ear bud retained by said retaining means, said ear bud axis extends forward and rearward so as to be positioned parallel to the lower jawbone line of said human head when said ear loop is worn on the ear of said human head.

8. The ear loop of claim 7, wherein said retainer means comprises a pair of curved, resilient arm members.

9. The ear loop of claim 8, wherein said arm members face inward.

10. The ear loop of claim 7, wherein said hook portion and said rear segment lie in a first plane, said transition segment extends outwardly from said first plane, and said forward segment lies in a second plane that is not coplanar with but is parallel to said first plane.

* * * * *